US006021911A

United States Patent [19]

Glickman et al.

[11] Patent Number: 6,021,911

[45] Date of Patent: Feb. 8, 2000

[54] GRAPPLER SWAY STABILIZING SYSTEM FOR A GANTRY CRANE

[75] Inventors: Myron Glickman, Arlington Heights; Brian Zakula, Mokena, both of Ill.

[73] Assignee: Mi-Jack Products, Hazel Crest, Ill.

[21] Appl. No.: 09/032,702

[22] Filed: Mar. 2, 1998

[51] Int. Cl.[7] ..... B66C 13/06

[52] U.S. Cl. ..... 212/345; 212/274

[58] Field of Search ..... 212/274, 324, 212/325, 326, 327, 345

[56] References Cited

U.S. PATENT DOCUMENTS

| | | | |
|---|---|---|---|
| 3,789,998 | 2/1974 | Fathauer et al. . | |
| 4,563,030 | 1/1986 | Makino . | |
| 5,018,631 | 5/1991 | Reimer . | |
| 5,022,543 | 6/1991 | Versteeg . | |
| 5,048,703 | 9/1991 | Tax et al. . | |
| 5,314,262 | 5/1994 | Meisinger et al. | 212/274 |
| 5,526,946 | 6/1996 | Overton . | |
| 5,715,958 | 2/1998 | Fieder et al. | 212/345 |
| 5,769,250 | 6/1998 | Jussila et al. | 212/274 |

FOREIGN PATENT DOCUMENTS

| | | |
|---|---|---|
| 3727329 | 3/1989 | Germany . |
| 58-82986 | 5/1983 | Japan . |
| 2-132095 | 5/1990 | Japan . |
| 567658 | 8/1977 | U.S.S.R. . |
| 1542821 | 3/1979 | United Kingdom . |

*Primary Examiner*—Thomas J. Brahan
*Attorney, Agent, or Firm*—Leydig, Voit & Mayer, Ltd.

[57] ABSTRACT

A sway stabilizing system is provided for stabilizing sway of a grappler suspended by vertically movable hoisting cables on a gantry crane. The crane is a type which is particularly useful for lifting a standard container from a standard-height chassis, such as a standard road trailer. According to the invention, the system is designed to optimally dampen sway when the grappler is slightly higher than the top of a standard container resting on a standard chassis. More particularly, in order to cancel pendulum sway effect, the sway stabilizing system provides first and second anti-sway cables which are operably guided from the grappler to an overhead trolley of the crane in a longitudinally diagonal manner. The anti-sway cables are acted upon by respective hydraulic cylinder assemblies mounted on the grappler to apply appropriate tension in the respective anti-sway cables. The cylinder assemblies act in opposite directions to dampen grappler sway in both directions along a longitudinal axis. So that the length of the anti-sway cables is adjusted accordingly with the vertical lifting movement of the grappler, the hoisting cables and anti-sway cables are paid out by respective rotatable drums which are rotatably coupled with each other in a constant drive ratio. The geometry of the guided anti-sway cables results in a non-linear payout rate relative to the vertical lifting rate of the grappler, resulting in payout "error" in the lengths of the anti-sway cables both above and below a design optimization point at which the payout error is zero. The error is compensated by appropriately extending or retracting the respective hydraulic cylinders. The drum drive ratio and a neutral position of the hydraulic cylinders are designed such that the payout error of the anti-sway cables is about zero when the grappler is about one foot higher than a height of the standard shipping container on top of a standard chassis.

28 Claims, 6 Drawing Sheets

GRAPPLER SWAY STABILIZING SYSTEM FOR A GANTRY CRANE

FIELD OF THE INVENTION

This invention relates to a sway stabilizing system, and more particularly to a sway stabilizing system for dampening sway motion of a grappler on a gantry crane.

BACKGROUND OF THE INVENTION

In intermodal facilities, ports, railyards or other such facilities referred to herein as "shipping yards," containers are typically handled (i.e., lifted, lowered and transported) by a gantry crane having a wire rope hoisting system. Such a gantry crane usually has a rigid frame with vertical columns supporting two or more horizontal beams or tracks. An elevated hoisting system is mounted to the upper tracks. The hoisting system conventionally includes a trolley and a grappler which is movably suspended from the trolley for engaging, lifting, and lowering a standard container. The crane is equipped with wheels drivable by a conventional power source (e.g., hydraulic or electric motors) to enable movement of the crane around the shipping yard and to position the hoisting system over a container or stack of containers to be handled. Usually, the gantry crane also has a cab to occupy a human operator controlling the crane.

Conventionally, the grappler is suspended by wire ropes or cables. In particular, the grappler is conventionally suspended by one or more hoisting cable which is coilably paid out and/or retracted from a rotatable hoisting drum mounted on the overhead trolley. The grappler is lifted and lowered by selectively rotating the hoisting drum with a corresponding rotation.

The grappler and standard containers are cooperatively configured with standard dimensions. The grappler is conventionally rectangular, having four corner-mounted twistlocks configured and positioned to matably engage respective locking holes disposed in the top of a standard rectangular container. The twistlocks are remotely actuatable to be selectively locked with the locking holes, enabling the grappler to lift the container. Therefore, when a container is to be lifted by the crane, the operator must properly align the grappler relative to the container below so that the twistlocks are properly received in the respective locking holes on the container.

In shipping yards, containers must typically be loaded and/or unloaded from a standard chassis (e.g., a truck bed or a rail car). Typically, the gantry crane is driven over the container and stopped when the grappler is generally over the container. When positioned vertically over the container, the grappler is lowered by the hoisting cables so that the grappler twistlocks are received in the locking holes in the container. Thereafter, the grappler and container are elevated by the hoisting cables to lift the container from the chassis. The gantry crane can then carry and unload the container at a desired location (e.g., on the ground, on a pallet, on top of a stack of containers, on another chassis, etc.). The twistlocks are then disengaged from the container.

Because a grappler is suspended on flexible hoisting cables, the grappler is undesirably susceptible to swaying or pendulum movement. In particular, horizontal movement of the traveling crane is translated into pendulum movement of the grappler once the crane is stopped. The pendulum effect and the magnitude of grappler sway tend to increase with the paid-out length of the hoisting cables (i.e., the closer the grappler is to the ground). The swaying is most significant in a longitudinal direction corresponding to a forward-reverse axis along which the crane primarily travels.

The swaying of the grappler is problematic. Specifically, the swaying can frustrate the aligning of the grappler over a container to be lifted so that the twistlocks are received into the respective locking holes in the container. Also, swaying can add difficulty to accurately positioning a lifted load over a desired location for unloading. The crane operator must wait until the swinging of the grappler subsides. This results in undesirable waiting time to allow the swaying motion of the grappler to subside. Such waiting time directly effects the loading efficiency, loading turnaround time and profitability of a shipping yard.

It is desirable to dampen the sway of the suspended grappler. Dampening the sway reduces the amount of time needed for sway abatement. Thereby, the grappler is easier to align, and load handling times are desirably reduced, increasing loading efficiency.

Moreover, if the grappler is lowered or raised when the swaying has not yet abated, the grappler and wire rope system will be subject to increased load stresses as the grappler is lowered and raised compared to if it was not swaying. Such stress is undesirable and can potentially damage the grappler, the wire rope system, and any suspended load. Also, a swinging grappler presents a danger of inadvertently knocking the grappler into other objects. Thus, it is also desirable to dampen sway to minimize wear and tear on the components of the gantry crane.

A frequently-occurring grappler height requiring a substantial hoisting cable payout length is when the grappler is positioned to lift a container resting on a chassis. However, known sway-stabilizing systems have not been optimized for maximum anti-sway capabilities at a grappler height corresponding to one foot above the height of a standard shipping container on a standard chassis. Accordingly, known sway-stabilizing systems do not optimize shipping yard efficiency, because such systems are not designed maximizing sway dampening, and minimizing sway stabilization time, at the height that containers are most frequently lifted. Moreover, previous sway stabilizing systems have required complicated hydraulic systems to stabilize sway, disadvantageously increasing costs and the probability of mechanical failure.

An improved grappler sway-stabilizing system is needed which optimizes sway abatement and increases efficiency.

SUMMARY OF THE INVENTION

Because many lifting and lowering operations require vertically positioning the grappler to engage a standard container on a standard chassis, it is at this height (i.e., of a container on a chassis and taking into account a one foot clearance) that optimized sway stabilization is most desirable. The present invention provides an improved sway stabilizing system for stabilizing sway of a grappler suspended by vertically movable hoisting cables on a gantry crane. The crane is a type which is particularly useful for lifting a standard container from a standard-height chassis, such as a standard road trailer. According to the invention, the system is configured to optimally dampen sway when the grappler is positioned to engage the top of a standard container resting on a standard-height chassis.

More particularly, in order to cancel pendulum sway effect, the sway stabilizing system provides first and second anti-sway cables which are operably guided from the grappler to an overhead trolley of the crane in a longitudinally diagonal manner. The anti-sway cables are acted upon by respective hydraulic cylinders mounted on the grappler to tension the cables, the cylinders applying appropriate tension in the respective cables acting in opposite directions to dampen grappler sway motion along a longitudinal axis of the crane. So that the length of the anti-sway cables is adjusted accordingly with the vertical lifting movement of the grappler, the hoisting cables and anti-sway cables are paid out by respective rotatable drums which are rotatably coupled with each other in a constant positive drive ratio. The geometry of the guided anti-sway cables results in a non-linear payout rate relative to the vertical lifting rate of the grappler, resulting in payout "error" in the lengths of the anti-sway cables both above and below a design optimization point at which the payout error is about zero. The "error" is compensated by appropriately extending or retracting the respective hydraulic cylinders in order to prevent otherwise too much tension or slacking of the anti-sway cables. The drum drive ratio and a neutral position of the hydraulic cylinders are designed such that the payout "error" of the anti-sway cables is about zero at a design height. According to the invention, the design height is at a height of about the height of a standard shipping container on top of a standard chassis. More specifically, in order to provide clearance, the design height is approximately one foot above the height of a container on a chassis.

In a preferred embodiment, each of the anti-sway cables has an end which is securely fixed to the grappler, and each of the hydraulic cylinders has a sheave rotatably mounted on an end of the extendible piston rod. These sheaves mounted on the piston rods contact and act on the respective anti-sway cables to transfer the forces of the hydraulic cylinders to the respective anti-sway cables. This advantageously results in a two-to-one ratio of cable-length-correction relative to piston rod movement. Additionally, side-loading of the piston rod is advantageously avoided.

An advantage of the invention is that it provides an improved a sway stabilizing system for dampening longitudinal sway of a grappler in minimal time.

Another advantage of the present invention is that it provides a sway stabilizing system that optimizes sway dampening performance at an anti-sway cable pay-out length at which the grappler is at a height equivalent to one foot above the height of a standard container on a standard chassis.

A further advantage of the present invention is that it provides a sway stabilizing system wherein the pay-out error in the anti-sway cables is substantially zero when the grappler is at a height equivalent to one foot above the height of a standard shipping container located on a standard chassis.

Yet another advantage of an embodiment of the present invention is that it provides a sway stabilizing system which is capable of absorbing at least 25% of the maximum sway kinetic energy of a maximum-loaded container that is 48 inches above the ground.

A still further advantage of the present invention is that it provides a sway stabilizing system that is optimally energy efficient.

These and other features and advantages of the invention are described in, and will be apparent from, the detailed description of the preferred embodiments and from the accompanying drawings.

TABLE 1 lists various properties and dimensions for a preferred embodiment of a crane with a sway stabilizing system according to the invention.

DETAILED DESCRIPTION OF THE INVENTION

Figure 1:
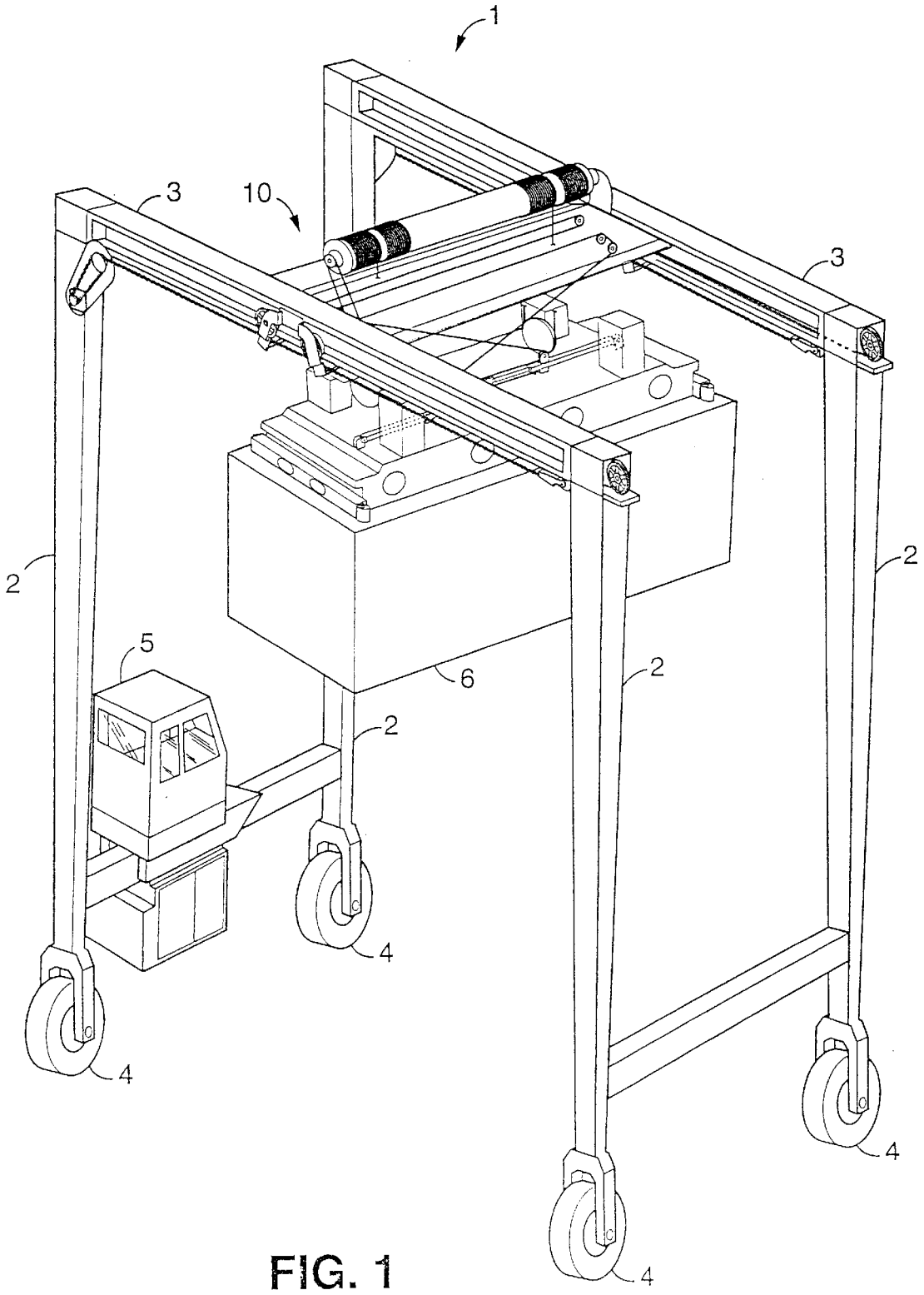
FIG. 1 is a perspective view of a crane according to the invention with the grappler secured to a shipping container.

Referring now to the Figures, wherein like numerals designate like components, FIG. 1 illustrates a gantry crane 1. The crane 1 has a frame including four columns 2 supporting two parallel, horizontal tracks 3 The hoisting structure 10 is movably mounted on the tracks for side-to-side movement. The crane 1 includes four wheels 4 respectively mounted to the bottom of the four columns 2, facilitating rollable movement of the gantry crane 1 from one location to another. A control cabin 5 is mounted to the frame to accommodate an operator who controls the entire operation of the gantry crane. The gantry crane 1 is used to lift, lower, and transport a standard shipping container 6.

Figure 2:
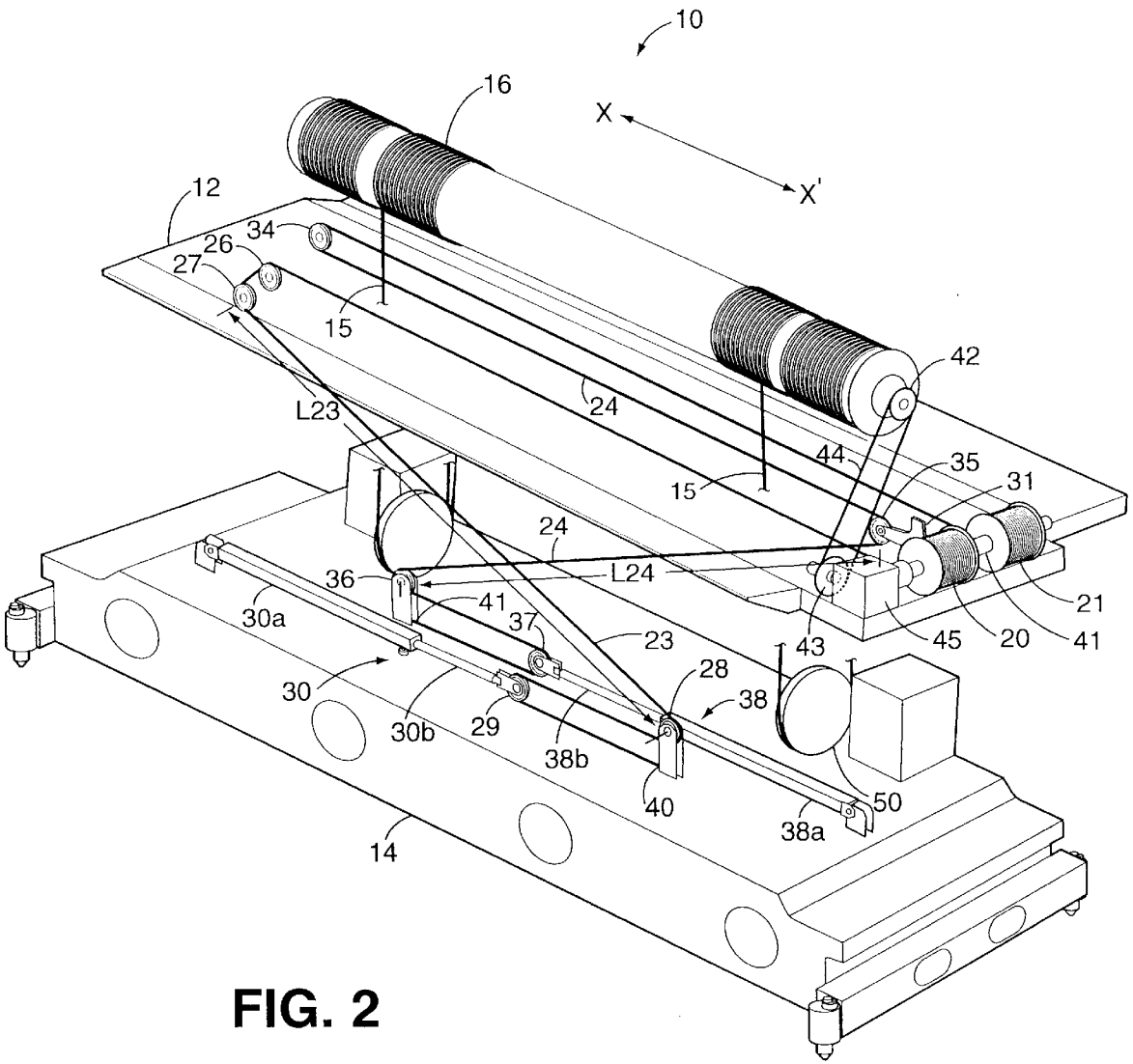
FIG. 2 is a perspective view of the hoisting structure according to the invention illustrating lifting cables and anti-sway cables.

As illustrated in FIG. 2, the hoisting structure 10 of the gantry crane 1 has a movable trolley 12 and a grappler 14. In an alternative embodiment, the control cabin 5 may be mounted to the movable trolley 12 which holds the hoisting mechanism. In the embodiment illustrated, the trolley 12 is movably coupled to the horizontal parallel tracks 3 of the mobile gantry crane 1 for adjusting the side-to-side position of the grappler 14. The trolley 12 is disposed at a fixed height from the ground. The grappler 14 is suspended from hoisting cables 15 that are wound around the hoisting drum 16. The hoisting drum 16 is selectably rotatable by an appropriate drive (such as a hydraulic or electric motor) to extend or retract the hoisting cables 15 for respectively lifting or lowering the grappler 14. When a container is to be transported, the grappler 14 is coupled to the container via twistlocks, and the container and the grappler 14 are lifted and/or lowered via the hoisting cables 15 and hoisting drum 16. The hoisting cables 15 and hoisting drum 16 have enough rope pay-out to lower the grappler 14 completely to the ground, if desired.

The sway stabilization system of the present invention is explained in detail with reference to FIG. 3. The sway stabilization system comprises the anti-sway cable drums 20 and 21 located on one end of the longitudinal axis of the trolley 12. The anti-sway cable drums 20 and 21 pay-out and retract the anti-sway cables 23 and 24 as the grappler is lifted and lowered by the hoisting cables. Each of the anti-sway cables 23 and 24 is routed through its own respective sheave system and is connected to the grappler 14 at a fixed joints 40, 41, respectively.

Two hydraulic cylinder assemblies 30, 38 are provided, each respectively including a cylinder 30*a*, 38*a* and an extendible and retractable piston rod 30*b*, 38*b*. The cylinders 30*a*, 38*a* are securely mounted to the grappler 14. The anti-sway cables 23, 24 are fixed to the grappler 14 at respective fixed joints 40, 41, as described in greater detail below, so that the piston rods 30*b*, 38*b* can act against the anti-sway cables 23, 24 for tension control and length compensation.

The sheave system corresponding to anti-sway cable 23 comprises sheaves 26, 27, 28 and 29. Sheaves 26 and 27 are rotatably mounted to the trolley 12 forward of the anti-sway cable drum 20. The cable drum 20 and sheaves 26 and 27 are mounted to opposite ends of the trolley 12 along the axis x–x'. Sheave 28 is rotatably mounted to the grappler 14 and is located in between the cable drum 20 and sheaves 26, 27 along the axis x–x'. Sheave 29 is rotatably coupled to an end of piston rod 30*b* of the cylinder assembly 30. The cylinder assembly 30 is coupled to the grappler 14. Sheave 29 moves along the axis x–x' as piston rod 30*b* is extended or retracted from cylinder 30*a*, but at all times sheave 29 is located in between sheave 28 and sheaves 26, 27 along the axis x–x'. The movable piston rod 30*b* of cylinder assembly 30 is used to manipulate the tension of the anti-sway cable 23 by extracting the piston rod from, or retracting the piston-rod into, cylinder 30*a* of the assembly.

Figure 3:
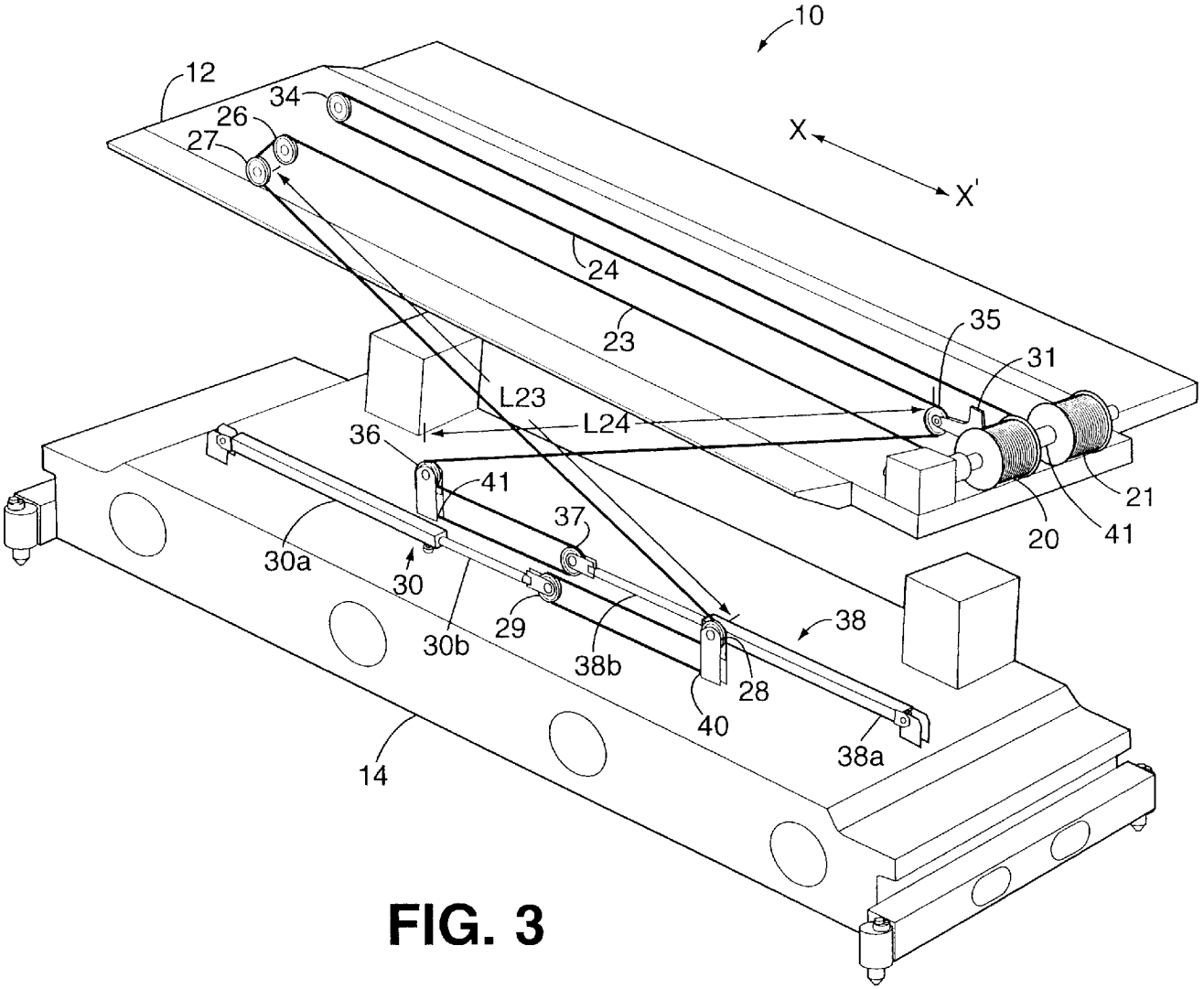
FIG. 3 is a perspective view of the hoisting structure of FIG. 2 wherein the lifting mechanism has been removed to illustrate the sway stabilizing system according to the invention in an isolated manner.

Still referring to FIG. 3, the sheave system corresponding to anti-sway cable 24 comprises sheaves 34, 35, 36, and 37. Sheave 34 is rotatably mounted to the trolley 12 such that the cable drum 21 and sheave 34 are located at opposite ends of the length of the trolley 12 along the axis x–x'. Sheave 35 is rotatably coupled to the trolley 12 and is located in between the cable drum 21 and sheave 34 along the axis x–x'. Sheave 36 is rotatably mounted to the grappler 14 and is located in between sheaves 34 and 35 along the axis x–x'. Sheave 37 is rotatably mounted to the end of piston rod 38*b* of the cylinder assembly 38. The cylinder 38*a* is fixed to the grappler 14. Sheave 37 moves along the axis x–x' as piston rod 38*b* is extended or retracted from cylinder 38*a*, but at all times sheave 37 is located in between sheaves 35 and 36 along the axis x–x'. The movable piston rod 38*b* of the cylinder assembly 38 is used to manipulate tension of the anti-sway cable 24 by extracting the piston rod from, or retracting the piston rod into, cylinder 38*a* of the assembly.

Sheave 27 on trolley 12, and sheave 28 mounted to the grappler 14, and sheave 29 rotatably mounted on the piston rod 30*b* of the cylinder assembly 30 are in a common vertical plane along axis x–x'. Similarly, sheave 35 mounted to the trolley 12 and sheave 36 mounted to the grappler 14, and sheave 37 rotatably mounted to the end of piston 38*b* of cylinder assembly 38 are in a common vertical plane along axis x–x'. Moreover, sheaves 27, 35 are positioned on the trolley 12, and sheaves 28, 36 are positioned on the grappler 14 so that that lengths L23 and L24 of the anti-sway cables 23 and 24 are equal when the grappler 14 is in a neutral position, i.e., when the grappler is not swaying. It is lengths L23 and L24 that are referred to whenever this disclosure compares the lengths of the two anti-sway cables 23 and 24. It should also be noted that by routing the anti-sway cables 23 and 24 around sheaves 29 and 37 mounted on piston rods 30*b* and 38*b*, respectively, and by attaching the cables 23 and 24 to the grappler 14 at fixed joints 40, 41, respectively, the invention obtains the advantage of doubling the length of anti-sway cable that can be moved by the piston rods 30*b* and 38*b*.

When sway occurs, depending on the direction of the sway, the lengths L23 or L24 of the anti-sway cables 23, 24 alternatively lengthen and shorten opposite each other. More specifically, when the grappler 14 sways toward the direction x' along the axis x–x', the length L23 of cable 23 increases while the length L24 of anti-sway cable 24 decreases, and vice versa when the grappler 14 sways toward direction x along the axis x–x'. In this situation, the cable tension forces in anti-sway cable 23 cause the piston rod 30*b* of the cylinder assembly 30 to extend out of the cylinder 30*a* to provide the necessary extra length of anti-sway cable. Oil from cylinder 30 is returned to the reservoir R (shown in FIG. 6) after being forced through a counter-balance valve 80 (shown in FIG. 6) mounted directly on the cylinder 30. At the same time, piston rod 38*b* of the cylinder assembly 38 must retract into the cylinder 38*a* to take up the slack in anti-sway cable 24 to maintain tension on anti-sway cable 24. As the motion of the grappler 14 reverses (as with a pendulum), the grappler 14 now moves in the direction x along the axis x–x'. After the grappler crosses the neutral position (i.e., where the length of anti-sway cables 23 and 24 are equal), the length of anti-sway cable 24 increases and the length of anti-sway cable 23 decreases and the entire process is repeated.

Figure 6:
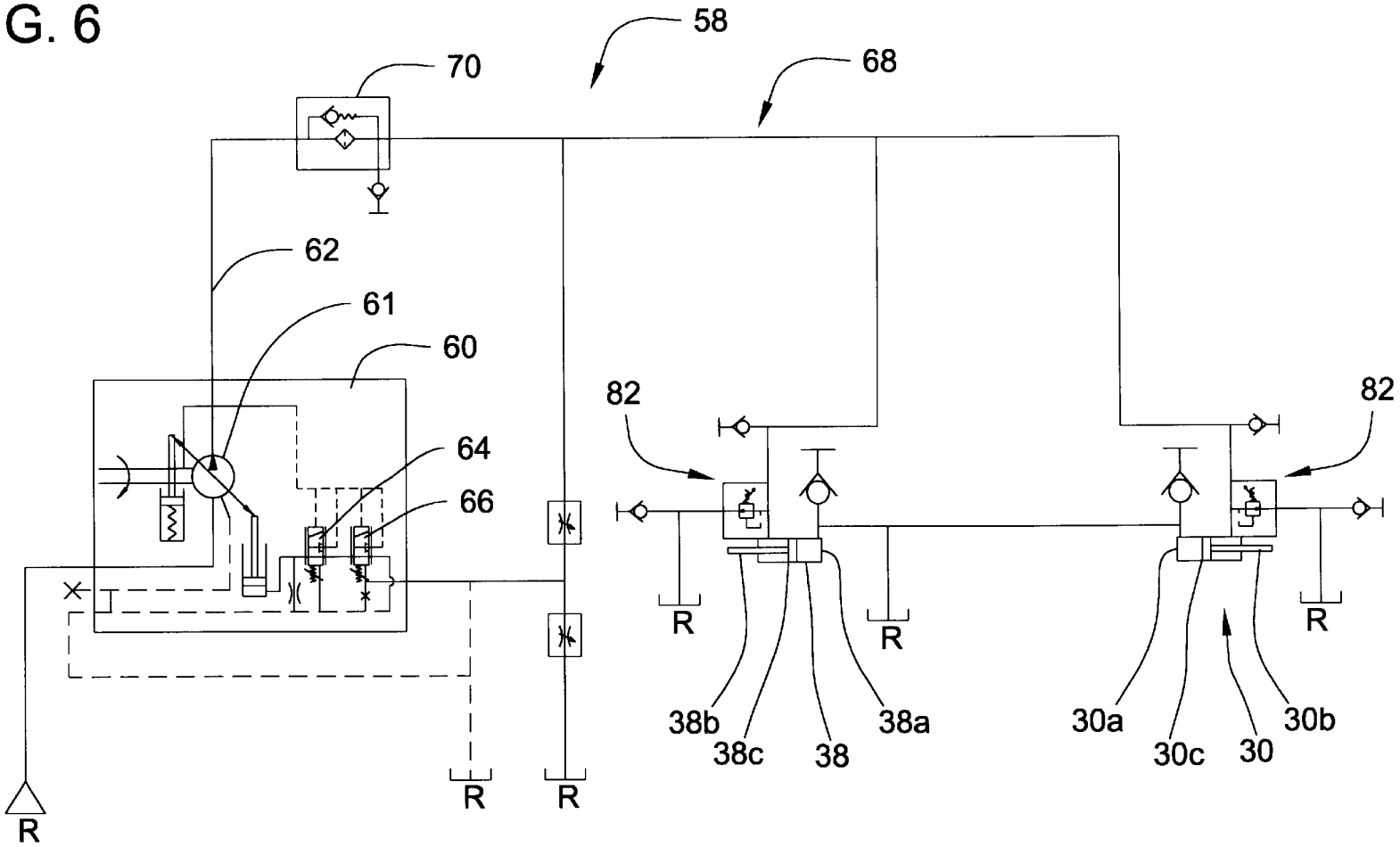
FIG. 6 is a diagramatic representation of the hydraulic system of the sway stabilizing system according to the invention.

The pressure in the two cylinder assemblies 30 and 38 is held constant by a load-sensing, variable-displacement hydraulic pump 60 (shown in FIG. 6). Therefore, the extension and retraction of the cylinders 30*b* and 38*b* creates a constant force acting on the swaying grappler 14. This force represents a greater proportion of the kinetic energy of the swaying grappler 14 (and any suspended load) with each successive pendulum-like swing of the grappler 14 (and any suspended load). As a result, the swaying motion of the grappler (and any suspended load) is very quickly damped out. The load-sensing, variable-displacement hydraulic pump and the hydraulic system of the cylinder assemblies 30, 38 are discussed in more detail hereinafter.

Referring back to FIG. 2, the two anti-sway cable drums 20 and 21 are driven by a common shaft 41. The shaft 41 is rotatably coupled to the hoisting drum 16 by a roller chain drive including a sprocket 42 fixed to the hoisting drum 16, a sprocket 43 fixed to drive a gear box 45, and a chain 44 driving the sprockets 42 and 43. In the illustrated embodiment, the gear box 45 is a type having bevel gears to result in transferring rotation from the sprocket 43 to the perpendicular shaft 41 on which the anti-sway drums are mounted. Consequently, when the hoisting drum 16 is rotated to lower or raise the grappler 14, the anti-sway cable drums 20 and 21 are also rotated to increase or decrease the length of the anti-sway cables 23 and 24. Thus, when the hoisting drum 16 is rotated to lower the grappler 14, the cable drums 20 and 21 rotate to increase the length of the anti-sway cables 23 and 24. Alternatively, when the hoisting drum is rotated to raise the grappler 14, the cable drums 20 and 21 rotate to decrease the length of the anti-sway cables 23 and 24.

As a result of the longitudinally diagonal angles on the anti-sway cables 23 and 24 as guided by the respective sheaves, the ratio between the length of hoisting cable 15 paid-out by the hoisting drum 16 and the amount of anti-sway cable 23, 24 paid-out by the anti-sway cable drums 20 and 21 is not constant. However, the rotation of the hoisting drum 16 relative to the anti-sway cable drums 20, 21 is constant as provided by the constant-ratio rotational coupling provided by the sprockets 42 and 43 and the gearbox 45. Accordingly, design considerations must determine an appropriate constant rotational ratio between the hoisting drum 16 and anti-sway drums 20, 21 to provide the optimal performance of the anti-sway system. The non-linear payout rate of the anti-sway cables results in either a positive "error" in anti-sway cable length (too much slack) or a negative "error" in anti-sway cable length (too taught) paid-out from the anti-sway drums 20, 21, in relation to the vertical grappler height as controlled by moving the hoisting cables 15. At some vertical grappler height, however, zero "error" occurs. The rotational ratio between the anti-sway drums and the hoisting drum is appropriately selected to achieve this zero "error" at a desired design height. Above the design height, positive error occurs, and below the design height, negative error occurs.

In the embodiment illustrated, wherein the gearbox 45 provides a 1:1 rotational ratio, the sprocket ratio between the sprockets 42 and 43 (i.e., the number of cogs on sprocket 42 versus the number of cogs on sprocket 43) is selected so that an ideal length of anti-sway cable is paid-out by the anti-sway cable drums 20, 21 when the grappler 14 is at a design height which is slightly (about 1 foot clearance) over the height of a standard shipping container located on a standard chassis (e.g., a road trailer). It is at this height that minimizing sway and maximizing sway dissipation is the most desired for loading and unloading operations in a shipping yard.

To compensate for any payout "error" occurring in the anti-sway cables when the grappler 14 is above or below the design height, the hydraulic cylinder assemblies 30, 38 act to appropriately extend or retract the anti-sway cables 23, 24 to maintain a desired amount of tension in the cables. More particularly, the cylinder assemblies keep the anti-sway cables 23, 24 from going slack or from becoming too taught so as to possibly undesirably absorb the vertical loading forces which are to be carried by the hoisting cables 15. Thus it is also desirable to configure the cylinder assemblies 30, 38 to have an appropriate stroke capacity to retract or extend as needed to compensate for any pay-out error, as well as having sufficient stroke capacity for dampening sway. Accordingly, the cylinders are set at a "neutral" position or optimum mid-stroke position which occurs at the zero error condition of the anti-sway cables 20, 21.

Ideal anti-sway cable lengths L23, L24 are sufficient to suspend the grappler 14 at a height equivalent to about one foot above the height of a standard shipping container on top of a standard chassis, while at the same time maintaining the piston rods 30*b*, 38*b* of the cylinder assemblies 30, 38 in a substantially neutral stroke position. The "neutral" stroke position of the illustrated cylinder assemblies 30 and 38 is defined as a point at which the respective piston rods 30*b*, 38*b* are extended approximately 50% of their extension capacity. For example, in the case of a piston rod 30*b*, 38*b* having total stroke of about 48 inches, the neutral position occurs when the piston rod 30*b*, 38*b* is extended 24 inches. Accordingly, If the length of anti-sway cables 23, 24 is not equal to the ideal length, then the difference between the actual length of anti-sway cables and the ideal length of anti-sway cables is the anti-sway cable pay-out error. If the actual length of anti-sway cable is longer than the ideal length of anti-sway cable, then the pay-out error is positive. If the actual length of anti-sway cable is less than the ideal length of anti-sway cable, then the pay-out error is negative. Positive pay-out error is compensated for by retracting the piston rods 30*b*, 38*b* into the cylinders 30*a*, 38*a* of the cylinder assemblies 30, 38. Negative pay-out error is compensated for by extending the piston rods 30*b*, 38*b* out of the cylinders 30*a*, 38*a* of the cylinder assemblies 30, 38.

Figure 4:
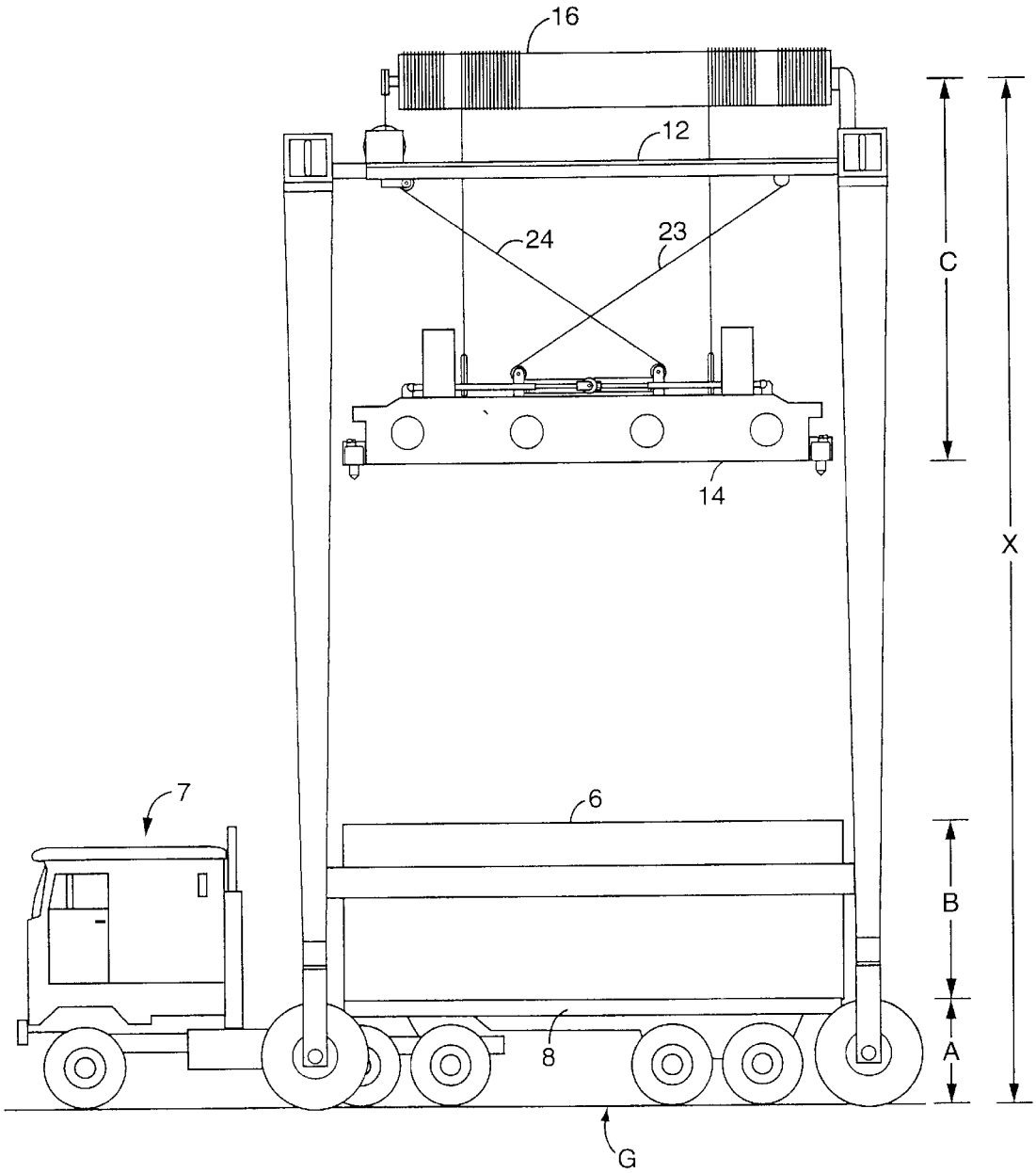
FIG. 4 is a side view of the crane of FIG. 1 shown positioned over a standard truck chassis carrying a standard shipping container.

Keeping the above in mind, the optimization of the sway stabilizing system according to the invention is now described with reference to FIG. 4. FIG. 4 is a side view diagrammatic representation of the gantry crane 1 positioned over a truck chassis 8 to lift a container 6 off the chassis. The distance A represents the standard height of the chassis relative to the ground G. The distance B represents the height of the standard shipping container 6. The distance X represents the height of the gantry crane as measured from the center of the axis of rotation of the hoisting drum 16 to the ground. The distance C is the distance between the center of the axis of rotation of the hoisting drum 16 to the bottom of the grappler 14 (i.e., at the point that it connects to the container 6). The invention requires that the various components of the sway stabilizing system be optimized such that the ideal amount of anti-sway cable is paid-out and the piston rods 30*b*, 38*b* are substantially in their neutral stroke position when:

$$C \text{ is about equal to } X-(A+B) \qquad [1]$$

Most preferably, equation [1] accounts for clearance of the grappler over a container, such that optimum dampening is provided according to the invention when the distance C is approximately one foot more than the distance X–(A+B).

In the preferred embodiment of the invention, a standard shipping container is 9½ feet high and a standard chassis is 48 inches off the ground. The preferred gantry crane is about 57 feet high, i.e., the center of the axis of rotation of the hoisting drum 16 is about 57 feet vertically off the ground. An exemplary sprocket ratio is sixteen cogs on sprocket 42 coupled to the main hoisting drum 16 and twenty-one cogs on sprocket 43 coupled to the drive shaft 41. It should be understood, however, that the rotational ratio between the hoisting drum 16 and the anti-sway drums 20, 21 depends on the diameters of the respective drums. The invention is not limited to a particular ratio, but the invention includes selecting an appropriate ratio such that the anti-sway cables are fed at a rate to result in the zero payout error condition at the specified grappler height. A system according to the invention can be modified to be optimized for any crane height, any size container or chassis, and diameter of the hoisting drum or anti-sway drum. In another embodiment, the hoisting drum 16 and shaft 41 driving the anti-sway drums may be coupled by two or more gears.

When, in the preferred embodiment, the grappler 14 is suspended more than 174 inches from the ground (i.e., the height of a preferred standard shipping container on top of a preferred standard chassis and including a one foot clearance), too much anti-sway cable is paid-out by the anti-sway cable drums 20, 21 and the piston rods 30*b*, 38*b* of the cylinders 30, 38 must both retract into the cylinders 30*a*, 38*a* to maintain adequate tension on the anti-sway cables. When the grappler 14 is suspended less than 174 inches from the ground, not enough anti-sway cable is paid-out by the anti-sway cable drums 20, 21 and the piston rods 30*b*, 38*b* of the piston cylinders 30, 38 must both extend out of the cylinders 30*a*, 38*a* to allow the grappler 14 to be lowered.

It should be noted that the principles described in the preceding paragraph in general apply to any sized crane, container and chassis. In other words, when the grappler is higher than the height of a typical container on a typical chassis (and including a one foot clearance), too much anti-sway cable is paid-out. Conversely, when the grappler is lower than the height of a typical container on a typical chassis (and including a one foot clearance) too little anti-sway cable is paid-out. It should also be noted that each of the cylinder assemblies has a piston stroke length and neutral position suitable to compensate for: (1) maximum positive and maximum negative anti-sway cable pay-out errors, and (2) maximum differences that occur in the length of the anti-sway cables when the grappler sways.

TABLE 1 lists the various specifications and dimensions of the preferred sway stabilizing system according to the invention optimized for the preferred crane, standard container and standard chassis. TABLE 1 lists information about the sway stabilizing system when the grappler is at a given height and is not swaying. The data in the Table is calculated assuming a standard sized container, which is 9½ feet tall and a standard sized chassis which is 48 inches tall.

TABLE 1 displays corresponding data for several exemplary operating situations (indicated in the leftmost column): (1) when the grappler 14 is on the ground, (2) when the grappler 14 is at the maximum height to which it can be lifted, (3) when the grappler 14 is at a height equivalent to the top of a standard 9½ feet high container located on a standard chassis 48 inches off the ground, and (4) when the grappler is at the height equivalent to the top of a 9½ feet high container located on top of (taking into account a one foot clearance): (a) one other container, (b) two other containers, (c) three other containers, and (d) four other containers.

For the above heights of the grappler, TABLE 1 lists the following information: (1) "h" is the distance between the bottom of the container being lifted or lowered by the grappler 14 and the ground, measured in inches. (2) "HD" is the vertical distance between the fixed-height trolley 12 and the grappler 14. HD is measured from the center of the axis of rotation of the main hoisting drum 16 and the center of the axis of rotation of sheaves 28 and 37, measured in inches. (3) "L" is the length of the anti-sway cables 23 and 24 between sheaves 27, 28 and sheaves 35, 36, respectively, and is measured in inches. Stated differently, L is the distance L23 or L24 as shown on FIG. 2 or 3. (4) "ΔHD" is the difference between HD at the current height of the grappler and "$HD_1$." $HD_1$ is the vertical distance between the trolley 12 and grappler 14 when the grappler is at the maximum height to which it can be lifted. Similarly to HD, $HD_1$ is measured from the center of the axis of rotation of the main hoisting drum 16 to the center of the axis of rotation of sheaves 28 and 36. (5) "ΔL" is the difference between L at the current position of the grappler and "$L_1$." $L_1$ is the distance L23 or L24 when the grappler is at the maximum height to which it can be lifted and is not swaying. (6) "MAIN DRUM REVS" is the number of revolutions performed by the main hoisting drum 16 to lower the grappler 14 from its maximum height to its current height. (7) "AUX DRUM REVS" is the number of revolutions performed by the anti-sway cable drums 20 and 21 when the grappler is lowered from its maximum height to its current height. (8) "$\Delta L_s$ SUPPLIED" is the length of anti-sway cable 23, 24 paid-out by the anti-sway cable drums 20, 21 at the current height of the grappler 14, measured in inches. (9) "ERROR" is the difference between the length of anti-sway cable 23, 24 paid-out by the anti-sway cable drums 20. 21 at the grappler's current height and the length of anti-sway cable required to lower the grappler to that height while maintaining the piston rods 30*b*, 38*b* of the cylinder assemblies 30, 38 at a neutral stroke position. (10) "CYL. STROKE" is the distance that the piston rods 30*b*, 38*b* are extended out of, or retracted into, the cylinders 30*a*, 38*a* to compensate for ERROR, measured in inches. The distance is measured from the neutral stroke position of the piston rods 30*b*, 38*b*.

As a first example, a situation is considered when the grappler is lowered completely to the ground. When the grappler 14 is lowered all the way to the ground, h is of course zero. At the same time, the distance HD between the trolley 12 and grappler 14 is 684 inches. The length L23, L24 of the anti-sway cables are 656.66 inches. The difference between HD and $HD_1$ is 603 inches and the difference between L and $L_1$ is 518.8 inches. At this height, however, the anti-sway cable drums 20, 21 have only paid-out 492.65 inches of anti-sway cable. Consequently, the anti-sway cables are actually short by 26.15 inches. This length must be compensated by the cylinders 30, 38 or the grappler 14 cannot be lowered to the ground. The extra 26.15 inches of length are provided by extending the piston rods 30*b*, 38*b* 13.075 inches out of the cylinders 30*a*, 38*a*, as measured from the neutral stroke positions of the respective piston rods 30*b*, 38*b*.

A second example considers a situation when the grappler 14 is at a height that enables it to lift a typical 9½ feet high shipping container located on a typical chassis that is 48 inches off the ground. At this height, ΔL is 361.06 inches. The anti-sway cable drums 20, 21 are capable of paying-out 360.28 inches of anti-sway cable length. Consequently, the piston rods 30*b*, 38*b* will only need to extend to compensate for 0.78 inches of anti-sway cable. By extending 0.39 inches from their neutral stroke position, the piston rods 30*b*, 38*b* are capable of compensating for this shortfall in anti-sway cable length. One can see that the system is optimized such that the length of anti-sway rope paid-out by the cable drums 20, 21 is substantially exactly the same as the distances L23, L24 when the grappler is at a height equivalent to the top of a typical container on a typical chassis.

As a final example, a situation is considered in which the grappler 14 is at a height equivalent to a container stacked on top of three other similar containers (including a one foot clearance). At this height, ΔL is 80.83 inches. The anti-sway cable drums 20, 21, however, have paid-out 110.28 inches of anti-sway cable. Consequently, the piston rods 30*b*, 38*b* will have to retract to compensate for the 29.45 inches of slack in the anti-sway cables. By retracting 14.72 inches from their neutral stroke position, the piston rods 30*b*, 38*b* are capable of compensating for the extra anti-sway cable paid-out by the cable drums 20, 21 and preventing any slack in the cables 23, 24.

The kinetic energy of the swaying grappler 14 (and any attached load) is absorbed by maintaining tension on the anti-sway cables 23, 24. The kinetic energy of the swaying grappler is determined by first determining the maximum undamped swinging velocity of the grappler 14 (and any attached load). Determining the maximum undamped swing velocity will be explained while referring to FIG. 5, which is a schematic representation of the sway stabilizing system of FIG. 3. Nodes 27 and 35 are schematic representations of sheaves 27 and 35 in FIG. 3, and nodes 28 and 36 are schematic representations of sheaves 28 and 36 in FIG. 3. Lines 23 and 24 represent the anti-sway cables 23 and 24 when the grappler 14 is not swaying and lines 23' and 24' represent the anti-sway cables 23 and 24 when the grappler is swaying in the direction x' along the axis x–x'. Assuming that the swinging motion of the grappler can be approximated by a sinusoidal function (which is a reasonable assumption for small pendulum-like oscillations), the angular movement of the grappler can be determined by the following equation:

$$A = A_{max} \text{ SIN } \omega t \qquad [2]$$

where ω=2 πf. The angular velocity of the grappler 14 (and any attached load), is then determined by calculating the first derivative of the angle A and is represented by the equation:

$$\mathring{A} = A_{max}\ \omega \text{ COS } \omega t \qquad [3]$$

The maximum linear horizontal velocity of the grappler because of undamped sway is expressed by the equation:

$$V=HA\times\mathring{A}=HA\times A_{max}\ \omega\mathrm{COS}\ \omega t \quad [4]$$

where HA is the vertical distance between the center of sheaves 27, 35 and the center of sheaves 28, 36, and where the angle $A_{max}$ is expressed in radians and ω is frequency in radians/second.

The kinetic energy (KE) of the grappler 14 (and any attached load) can now be expressed by the equation:

$$KE=\tfrac{1}{2}\ (W/g)\ V^2 \quad [5]$$

where W is the weight of the grappler 14 (and any attached load) and V is determined by equation [4].

The percent of kinetic energy (%KE) absorbed by the sway stabilizing system can be determined by the following equation:

$$\%KE=T_L\times\Delta L \quad [6]$$

where $T_L$ is rope tension and ΔL is the change in the length of the anti-sway cable because of the swaying motion of the grappler (and any attached load). ΔL for either of the anti-sway cables 23 or 24 can be found from the following trigonometric equations:

| | |
|---|---|
| $\mathrm{Tan}\ A_{23} = (HA - \Delta Y)/(K + \Delta X)$ | [7] |
| $\mathrm{Tan}\ A_{24} = (HA - \Delta Y)/(K - \Delta X)$ | [8] |
| $\mathrm{Tan}\ A = HA/K$ | [9] |
| $L_{23} = L_{24} = K/\cos A$ | [10] |
| $L_{23} = (K + \Delta X)/\cos A_{23}$ | [11] |
| $L_{24} = (K - \Delta X)/\cos A_{24}$ | [12] |
| $\Delta L_{23} = L_{23} - L_{23}$ | [13] |
| $\Delta L_{24} = L_{24} - L_{24}$ | [14] |

The rope tension is selected by determining ΔL and then choosing the portion of the maximum sway energy to be absorbed on the first swing of the sway motion. In the preferred embodiment of the gantry crane according to the invention, 25% of the kinetic energy of the motion is absorbed on the first swing of the sway motion. Furthermore, the cylinder assemblies 30, 38 have a capacity suitable to maintain the desired rope tension at the available hydraulic pressure. Furthermore, the cylinder assemblies 30, 38 must be able to extend or retract fast enough to maintain adequate tension on the anti-sway cables when the grappler 14 is lifted or lowered at the maximum hoisting speed of the hoisting drum 16.

For actuating the cylinder assemblies 30, 38, the invention includes a closed loop hydraulic system 58 as illustrated in FIG. 6. The sway stabilization system according to the invention includes a load-sensing, variable-displacement hydraulic pump 60 to maintain pressure in, and actuate, the cylinder assemblies 30, 38. The hydraulic system 58 of the invention is comprised of the variable-displacement, load-sensing hydraulic pump 60, and cylinder assemblies 30, 38. The pump 60 has a capacity sufficient to provide an adequate supply of hydraulic fluid to the cylinder assemblies 30, 38 when the grappler 14 is being lifted or lowered at the maximum hoisting speed of the hoisting drum 16 to ensure that the cylinder assemblies 30, 38 maintain adequate tension on the anti-sway cables 23, 24 at all times.

The hydraulic system 58 has a network of conduits 68 to provide hydraulic fluid communication between the pump 60 and the cylinder assemblies 30, 38. Because the cylinder assemblies 30, 38 are preferably identical to one another, the following explanation will refer only to cylinder assembly 30. It is to be understood, however, that cylinder assembly 38 operates in a similar manner.

Figure 5:
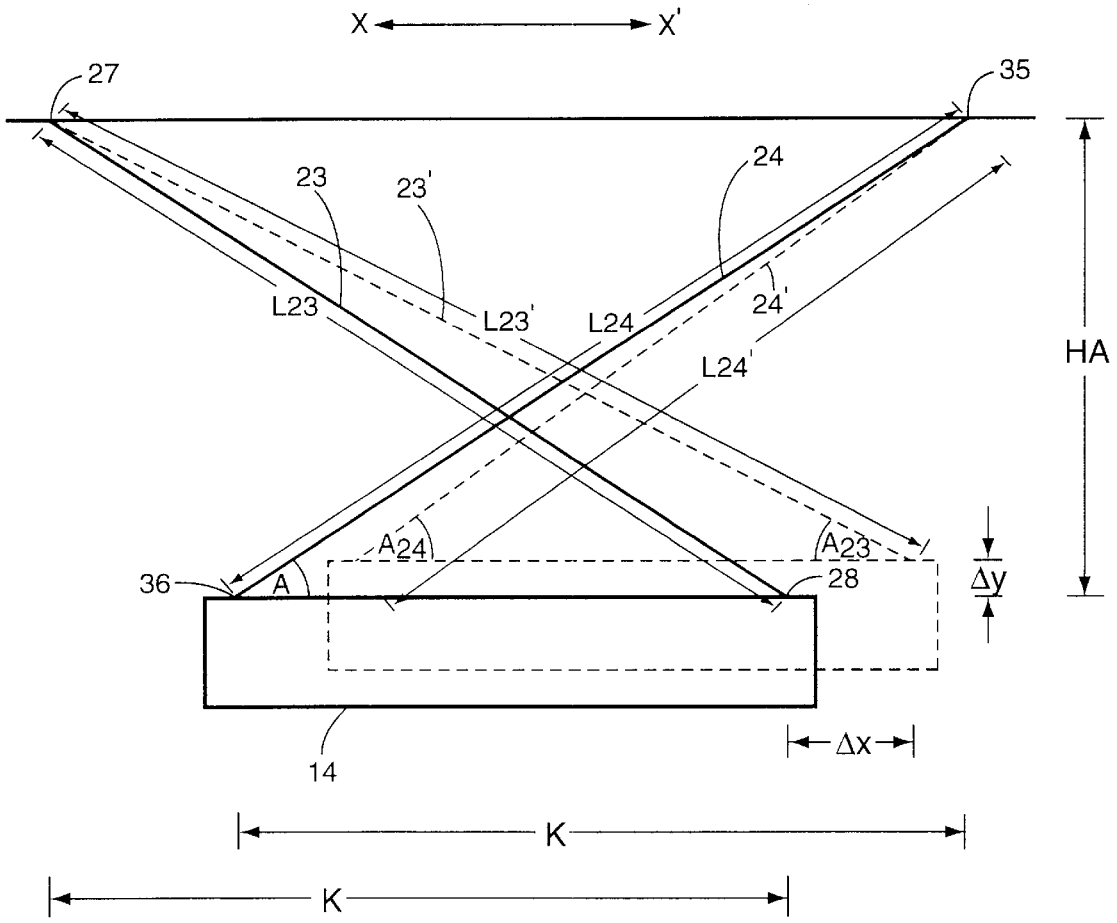
FIG. 5 is a schematic side view of the sway stabilizing system according to the invention, a sway condition being illustrated in phantom lines.

As shown, the cylinder assembly 30 includes a hydraulic cylinder 30*a* containing a reciprocal piston 30*c* connected to a piston rod 38*b*. Via the conduit system 68, the pump 60 is capable of selectively delivering pressurized hydraulic fluid to the piston rod side of the cylinder 30. Pump 60 is a variable-displacement, load-sensing pump. Pressure in the piston side of cylinder 30 creates a force which tends to retract piston rod 30*b* into cylinder 30. This retraction force is resisted by tension in the anti-sway cable. Thus, in a non-sway condition, retraction of the piston is resisted by the cable tension, and the retraction force created by the hydraulic pressure on the piston maintains constant tension in the anti-sway cable. When sway occurs in direction x', as shown in FIG. 5, the length of the anti-sway cable L23 increases. This causes piston rod 30*b* to extend, forcing fluid from the piston side of cylinder 30 to return to a fluid reservoir through the counterbalance valve 80. The passage of pressurized fluid through the counter balance valve generates heat which dissipates a portion of the kinetic energy of the swinging load.

During a sway condition, at the same time that anti-sway cable length L23 is increasing, anti-sway cable length L24 (FIG. 5) is decreasing. This tends to cause slack in cable L24. The pressurized fluid from pump 60 on the piston side of cylinder 38 (FIG. 6), causes piston 38*b* to retract into cylinder 38*a*, thus taking up the slack, and maintaining constant tension in the anti-sway cable 24. The fluid from pump 60 enters the piston side of cylinder 38 through a check valve portion of counter balance valve 82. When the direction of grappler sway reverses, the entire sequence reverses, with piston 38*b* extending due to the increased cable length L24 and piston 30*b* retracting due to slack in cable 23 and the delivery of pressurized fluid from the pump 60.

The pressure setting of the counter balance valves 80 and 82 (FIG. 6) is determined by the portion of sway kinetic energy to be absorbed on the first swing of the grappler 14 (and attached load).

The desired cable tension is determined by setting the load sensing valve 66 of pump 60. When there is no flow demand due to retraction of the piston rods in the cylinders, the load pressure is maintained with the pump at a minimum displacement condition. When a drop in pressure in line 68 caused slack rope in one or both cylinders, load sensing valve 66 causes the displacement of pump 60 to increase so that sufficient fluid flow rate is provided by the pump to maintain the set pressure. When the pressure setting is re-established, the action of the load sensing valve again causes the pump to go to a minimum displacement condition. Thus, as is common in load-sensing, variable-displacement hydraulic pumps, the pump will provide only a flow rate that is sufficient to maintain the load pressure. This results in an efficient system with fast response to flow demand. Pump 60 also has a maximum pressure limiting valve 64. This valve causes the pump to go to a minimum displacement condition when a set maximum pressure is reached. In this embodiment, the counter balance valves 80 and 82 are set slightly higher than the load sense valve 60, and the maximum pressure limiting valve is not used. A pressure filter with by-pass check valve 70 is supplied in pump pressure line 62.

While the invention has been described in connection with certain preferred embodiments, there is no intent to limit it to those embodiments. On the contrary, it is recognized that various changes and modifications to the exemplary embodiments described herein will be apparent to those skilled in the art, and that such changes and modifications may be made without departing from the spirit and scope of the present invention. Therefore, the intent is to cover all alternatives, modifications, and equivalents included within the spirit and scope of the invention as defined by the appended claims.

What is claimed is:

1. A gantry crane for lifting a container having a vertical dimension B from a position resting on a chassis having a vertical height A relative to the ground, the gantry crane being drivable along a longitudinal axis and comprising:

a frame;

a trolley assembly mounted to said frame in an elevated position;

a grappler adapted to engage a top of the container;

at least one hoisting cable generally vertically guided between the grappler and the trolley to suspend the grappler in a vertically movable manner;

a hoisting drum rotatably mounted to the trolley and having an end of the hoisting cable secured thereto, the hoisting drum having a center of axis of rotation positioned at a vertical distance X above the ground and a vertical distance C above a bottom of the grappler, the hoisting drum being rotatable to selectively lift or lower the grappler by the hoisting cable, thereby varying the distance C;

a pair of anti-sway cables operably guided in tension between the grappler and the trolley, one of said anti-sway cables being guided longitudinally diagonally to dampen forward longitudinal sway of the grappler relative to the trolley and the other anti-sway cable being guided longitudinally diagonally to dampen rearward longitudinal sway of the grappler relative to the trolley;

at least one anti-sway cable drum rotatably mounted to the trolley assembly, each of the anti-sway cables having an end secured to, and coiled around, said at least one anti-sway drum;

a positive drive rotatably coupling said at least one anti-sway drum to the hoisting drum at a constant drive ratio so that the anti-sway cables are coilably paid out and retracted from said at least one anti-sway drum upon vertical movement of the grappler;

a pair of cylinder assemblies mounted to the grappler, each of the cylinder assemblies having an extendible piston rod adjustably moving against a respective one of the anti-sway cables to compensate for vertical length differences between the anti-sway cables and the hoisting cable due to a varying payout rate of the anti-sway cables relative to the hoisting cable while maintaining predetermined tensions in said anti-sway cables, each of the piston rods being reciprocally movable to either increase or decrease tension in the respective anti-sway cable, each of the cylinder assemblies having a neutral position wherein the respective piston rod is at a stroke position which provides an optimum stroke capacity for potentially dampening sway;

wherein said ratio of said positive drive is selected such that when C is about equal to X−(A+B), in a non-swaying condition, the anti-sway cables are at a theoretically correct length, such that each of the piston rods of the cylinder assemblies are at a neutral position, wherein the piston rods normally extend beyond the neutral position when C is greater than about X−(A+B), and wherein the piston rod are normally retracted from the neutral position when C is less than about X−(A+B).

2. A crane according to claim 1, wherein each of the said piston rods operable to add tension to the respective anti-sway cable when the piston rod is retracted and being operable to release tension from the respective anti-sway cable when the piston rod is extended.

3. A crane according to claim 1, wherein said ratio of said positive drive is selected such that each of the piston rods of the cylinder assemblies are at a neutral position when C is approximately one foot over X−(A+B).

4. A crane according to claim 1, wherein A is about 48 inches.

5. A crane according to claim 1, wherein B is about 9½ feet.

6. A crane according to claim 1, wherein said drive includes a sprocket fixed relative to the hoisting drum, a gearbox, a sprocket fixed to drive the gearbox, the gearbox having an output shaft fixed to drive the anti-sway drum, and a chain cooperatively driving the sprockets.

7. A crane according to claim 1 including two of said anti-sway drums fixed together on a common rotational shaft, each of said anti-sway drums accommodating a respective one of the anti-sway cables.

8. A crane according to claim 1, wherein said payout rate of said anti-sway drums varies non-linearly relative to the vertical position of the grappler.

9. A crane according to claim 1, further comprising a pair of sheaves rotatably mounted to respective piston rods, each of the anti-sway cables being guided over the respective sheave.

10. A mobile gantry crane for lifting a standard container from a standard chassis, the crane being drivable along a longitudinal axis and comprising:

a frame supportable on the ground;

a trolley assembly mounted to said frame in an elevated position;

a grappler adapted to engage a top of a standard container;

at least one hoisting cable generally vertically guided between the grappler and the trolley to suspend the grappler in a vertically movable manner;

a hoisting drum rotatably mounted to the trolley and having an end of the hoisting cable secured thereto, the hoisting drum being rotatable to selectively lift or lower the grappler by the hoisting cable;

a pair of anti-sway cables operably guided in tension between the grappler and the trolley, one of said anti-sway cables being guided longitudinally diagonally to dampen forward longitudinal sway of the grappler relative to the trolley and the other anti-sway cable being guided longitudinally diagonally to dampen rearward longitudinal sway of the grappler relative to the trolley;

at least one anti-sway cable drum rotatably mounted to the trolley assembly, each of the anti-sway cables having an end coiled around said at least one anti-sway drum;

a positive drive coupling said at least one anti-sway drum to rotate at a constant ratio relative to the hoisting drum so that the anti-sway cables are paid out and retracted from said at least one anti-sway drum upon vertical movement of the grappler, the payout rate of the anti-sway cables varying non-linearly relative to the payout rate of the hoisting cable;

a pair of cylinder assemblies mounted to the grappler, each of the cylinder assemblies having an extendible piston rod acting against a respective one of the anti-sway cables to maintain a desired amount of dampening tension on said cables, wherein each of the piston rods retract to compensate for positive length error in the respective anti-sway cable when the grappler is higher than a design height, each of the piston rods extend to compensate for negative length error in the respective anti-sway cable when the grappler is lower than a design height, the design height being about the height of a standard container on a standard chassis;

wherein said ratio of said positive drive is selected such that when the grappler is about at the height of a standard container on a standard chassis, each of the piston rods is in a neutral stroke position which provides an optimum sway-dampening capacity for potentially dampening sway.

11. A crane according to claim 10, wherein said ratio of said positive drive is selected such that each of the piston rods of the cylinder assemblies are at a neutral position when the grappler is approximately one foot over the height of a standard container on a standard chassis.

12. A crane according to claim 10, wherein the height of a standard chassis is about 48 inches.

13. A crane according to claim 10, wherein the height of a standard container is about 9½ feet.

14. A crane according to claim 10 including two of said anti-sway drums fixed together on a common rotational shaft, each of said anti-sway drums accommodating a respective one of the anti-sway cables.

15. A crane according to claim 10, wherein said drive includes a sprocket fixed relative to the hoisting drum, a gearbox, a sprocket fixed to drive the gearbox, the gearbox having an output shaft fixed to drive the anti-sway drum, and a chain cooperatively driving the sprockets.

16. A crane according to claim 10, further comprising a pair of sheaves rotatably mounted to respective piston rods, each of the anti-sway cables being guided over the respective sheave.

17. A crane according to claim 10, wherein each of the piston rods is in its respective neutral position when it is extended about one half of its stroke capacity.

18. A crane according to claim 10, wherein each of the piston rods has a total stroke of about 48 inches, and wherein the neutral position is when the piston rod is extended about 24 inches.

19. A sway stabilizer for stabilizing a load bearing grappler in a hoisting system, the load bearing grappler capable of being lifted and lowered vertically by hoisting cables wound around a hoisting drum on a trolley assembly, the grappler and trolley assembly being movable on parallel tracks along the length of the hoisting system comprising:

first and second anti-sway cable drums attached to one end of the trolley assembly and mounted to the same drive shaft;

first and second cylinder assembly opposingly mounted along the longitudinal axis of the grappler;

first and second anti-sway cables respectively wound around the first and second anti-sway cable drums at one end and fixed to the grappler at an opposite end, wherein the anti-sway cable drums are drivably coupled to the hoisting drum by a roller chain drive with a constant gear ratio between the hoisting drum and the first and second anti-sway cable drums;

the first and second anti-sway cables routed through a first and second sheave system respectively;

the first and second cylinder assemblies maintaining tension in the first and second anti-sway cables to cancel out longitudinal sway forces; and the sheave systems being dimensioned and the constant gear ratio being selected such that the length of anti-sway cables are equal and said piston rods of the first and second cylinder assemblies are respectively in substantially neutral positions when the grappler is at height approximately one foot higher than a height of a container on a chassis.

20. A sway stabilizing system for a gantry crane movable along a front-to-rear longitudinal axis, the gantry crane having a frame, a trolley assembly coupled to the frame in an elevated position relative to the ground, a hoisting drum rotatably mounted to the trolley assembly, a grappler suspended from the hoisting cables coiled around the hoisting drum, the hoisting drums being rotatable to selectively pay-out or take-up the hoisting cables and thereby lift or lower the grappler, the sway stabilizing system comprising:

at least one anti-sway cable drum rotatably mounted to the trolley assembly;

first and second anti-sway cables each having an end coiled around the at least one anti-sway cable drum, and an opposite end secured to the grappler;

first and second sheave systems through which the first and second anti-sway cables are respectively guided;

first and second cylinder assemblies mounted along the longitudinal axis of the grappler each of the assemblies having an extendible piston rod operate to tension a respective one of the anti-sway cables, wherein the first and second cylinder assemblies maintain tension in the first and second anti-sway cables to cancel longitudinal sway forces;

the first sheave system comprising a first and second sheave mounted forwardly of the first anti-sway cable drum on the trolley assembly, a third sheave mounted to the grappler rearwardly of the first and second sheave, and a fourth sheave mounted to the piston rod of the first cylinder assembly, wherein the first anti-sway cable is guided sequentially through said sheaves of the first sheave system;

the second sheave system comprising a fifth sheave mounted to the trolley assembly forwardly of the second anti-sway cable drum, a sixth sheave mounted to the trolley assembly rearwardly of the fifth sheave, a seventh sheave mounted to the grappler forwardly of the sixth sheave, and an eighth sheave mounted to the extendible piston rod of the second cylinder assembly, wherein the second anti-sway cable is guided sequentially through said sheaves of the second sheave system.

21. The sway stabilizer of claim 20, wherein the at least one anti-sway cable drums are rotatably coupled to the hoisting drum by a linkage so that rotation of the hoisting drum causes rotation of the anti-sway drums.

22. The sway stabilizer of claim 21, wherein the hoisting drum is drivably coupled to the first and second anti-sway cable drums by a roller chain drive and a bevel gearbox.

23. The sway stabilizer of claims 20, wherein the hoisting drum and the first and second anti-sway cable drums rotate at a constant ratio of revolution relative to the hoisting drum.

24. The sway stabilizer of claim 20 further comprising a load-sensing, variable displacement hydraulic pump for providing hydraulic pressure to the first and second cylinder assemblies.

25. The sway stabilizer of claim 20, wherein the length of the first and second anti-sway cables is equal when the grappler is not swaying.

26. The sway stabilizer of claim 20, wherein a sprocket ratio between the hoisting drum and the first and second anti-sway cable drums is optimized so that the first and second piston rods of the first and second cylinder assemblies are respectively in substantially neutral stroke positions when the grappler is at a height approximately one foot higher than a height of a standard container on a standard chassis.

27. The sway stabilizer of claim 20, wherein a sprocket ratio between the hoisting drum and the first and second anti-sway cable drums is optimized so that said piston rods of the first and second cylinder assemblies are respectively in substantially neutral stroke position when the grappler is at a height of about 174 inches from the ground.

28. The sway stabilizer of claim 20, wherein the first and second cylinders have a piston stroke length sufficient to fully compensate for a positive anti-sway cable pay-out error or a negative anti-sway cable pay-out error and for a change in the length of the first and second anti-sway ropes as a result of sway.

* * * * *